US006038715A

United States Patent [19]

Flieger et al.

[11] Patent Number: 6,038,715

[45] Date of Patent: Mar. 21, 2000

[54] MULTIPLE SHOWER COMBINATION

[75] Inventors: Horst Flieger, Schiltach, Germany; John Marshall, Milton, Pa.

[73] Assignee: Hansgrohe AG, Germany

[21] Appl. No.: 09/083,314

[22] Filed: May 22, 1998

[51] Int. Cl.[7] ..... A47K 3/22

[52] U.S. Cl. ..... 4/601; 4/615

[58] Field of Search ..... 4/567, 570, 601, 4/605, 615

[56] References Cited

U.S. PATENT DOCUMENTS

| | | | |
|---|---|---|---|
| 3,806,963 | 4/1974 | Flynn | 4/615 |
| 3,827,088 | 8/1974 | Arnold et al. | 4/192 |
| 3,971,074 | 7/1976 | Yxfeldt | 4/145 |
| 4,561,136 | 12/1985 | Baer | 4/615 |
| 5,035,010 | 7/1991 | Sakamoto et al. | 4/567 |
| 5,121,511 | 6/1992 | Sakamoto et al. | 4/601 |
| 5,321,860 | 6/1994 | Steinhardt et al. | 4/601 |
| 5,678,258 | 10/1997 | Healy | 4/601 |

FOREIGN PATENT DOCUMENTS

| | | |
|---|---|---|
| 2852265 | 6/1980 | Germany . |
| 8506749 | 8/1985 | Germany . |
| 3901162 | 7/1990 | Germany . |
| 9308724 | 5/1993 | WIPO . |

OTHER PUBLICATIONS

1993, Duschvergnugen schnell montiert, In: sbz, pp. 32–35.

1996, Das Duschpaneel. Die Stunde des Sanitarfachmanns, In IKZ, 11, pp. 59–62.

*Primary Examiner*—Robert M. Fetsuga

*Attorney, Agent, or Firm*—Duane, Morris & Heckscher LLP

[57] ABSTRACT

A multiple shower combination (11) is created, which carries at least two shower operational units (13, 14). By means of a water supply pipe (37), said multiple shower combination is connectable in water-carrying and mechanically supporting manner to a wall connection (54) for an overhead shower. The wall connection (54) at least partly carries the multiple shower combination (11).

The water supply pipe (37) can form part of a guide mechanism (43), on which a front panel (12) is vertically adjustable and in certain circumstances can be pivotably mounted about it.

50 Claims, 6 Drawing Sheets

MULTIPLE SHOWER COMBINATION

FIELD OF USE AND PRIOR ART

The invention relates to a multiple shower combination having at least two shower operational units.

A shower combination having two shower operational units is described in U.S. Pat. No. 38 27 088. On an elongated, vertically installed shower cabinet are provided at the upper end a fixedly fitted overhead shower and at the lower end a water outlet for a bath tub. The shower combination is connected by two pipes to a hot and a cold water pipe, which are located in or behind the wall, to which the shower combination is fixed. Thus, extensive installation work is necessary for fitting the shower combination.

Another solution is proposed in U.S. Pat. No. 39 71 074. In this case it is a question of a multiple shower combination with an arrangement of several over-head showers and one hand-held shower. It is connected by means of a connecting hose to the hand-held shower connection of a surface-mounted mixing battery or tap with a bath tub outlet. The hose hangs freely in the air. This leads on the one hand to a very untidy appearance on the other the risk exists that a person using the shower may be caught up in the hose and either damages the latter or falls and is injured.

PROBLEM AND SOLUTION

The problem of the invention is to provide a multiple shower combination, which eliminates the aforementioned disadvantages and which in simple manner can be connected to a water connection.

This problem is solved in that the multiple shower combination is connectable to a wall connection for an overhead shower.

In this way there is no need to lay new connecting pipes, which is both time-consuming and can also not be carried out without certain expert knowledge. During installation the multiple shower combination is merely connected, in place of an overhead shower, to the wall connection thereof, which, as a water connection, is more particularly supplied with premixed water from a mixer tap. The water connection is preferably located on the back of the wall or in the latter, in the form of a fixed water pipe. The wall connection is generally formed by a rigid connection end, which projects into a wall opening or out of the wall. The water-carrying connection between the mixer tap and multiple shower combination consequently runs in preferably at least partly invisible manner behind the wall. In addition, there is no need to fit a mixer tap to the multiple shower combination, because the water temperature can already be set on the existing mixer tap by the user through the mixing of cold and hot water.

The multiple shower combination preferably has a support frame, the position of the latter on the wall being determined by the wall connection. The support frame is preferably fixed and fixable in immovable manner to the wall and is designed so as to carry the multiple shower combination.

To the wall connection can be fixed and connected, preferably in vertical manner, a water supply pipe, which is preferably part of or forms the support frame. The water supply pipe can take over several functions and consequently simplifies the construction of the multiple shower combination. The water supply pipe can e.g. be connected by means of a clamping or box nut to the wall connection. It is at least partly water-carrying. Preferably the connection between the wall connection and the water supply pipe and in particular also the water supply pipe for the same purpose is designed to alone bear the weight of the multiple shower combination. This permits a simple, stable construction, particularly if the water supply pipe forms the support frame. The support frame and/or water supply pipe is preferably made from a material having the necessary strength, e.g. a copper pipe with an adequate wall thickness. In addition to the wall connection, the water supply pipe and/or the support frame can be fixed to the wall, particularly at or close to a mechanically free, preferably the lower, end, should this be desired. The fixing to the wall connection and at least one further point ensures a firm hold on the wall. Additional fixing can be provided by screwing to the wall, or by an adhesive or Velcro connection to the wall in order to avoid tile damage. This can also have a stabilizing and/or supporting function.

In order to provide a unitary, attractive appearance, the multiple shower combination can have a front panel, particularly an elongated front panel, to which are fitted and/or fittable at least one and preferably all the shower functional units. Thus, the multiple shower combination better presents itself as a constructional unit or shower cabinet, which can carry the shower functional units. Further holders for shower functional units, e.g. on the wall, are consequently rendered superfluous. The front panel can have a closed surface, which improves the optical impression and facilitates cleaning. It can be made in one or more pieces from plastic, e.g. by deep-drawing. However, it is also conceivable to manufacture it from metal or a combination of different materials.

So as to also provide a unitary, tidy appearance from the side, both sides and in particular both longitudinal sides of the front panel can be bent rearwards in such a way that it has an approximately U-shaped cross-sectional profile. Thus, the components located behind the front panel and the wall connection are at least partly covered. In the downwards direction the front panel is preferably open, so that spray can flow away downwards.

In a special development of the invention, one bent side of the front panel can be made shorter than the other, so that there is a cross-sectional profile in the form of a U with a shorter leg. The multiple shower combination can be fitted to the wall in such a way that the front panel is spaced from the wall at the shortened side, which gives at least partial access to the rear of the front panel.

Preferably, the front panel is constructed in a vertically adjustable manner, e.g. fixed and/or guided. Preferably there is at least one guide device, particularly on the back of the panel facing the wall and which is designed for fixing and/or guiding the front panel with at least one guide holder on at least one guide member. At least one guide member can be formed by the support frame, particularly the water supply pipe. The vertical adjustability permits an optimum use of the multiple shower combination by persons of different body size. The latter are provided with the possibility, by adjusting the height of the front panel of bringing one or more shower functional units to the desired height. Through the positioning of the guide device on the back of the front panel, it is at least partly concealed. For example, a first guide member can be formed by the water supply pipe and a second guide member can be constructed as a structural unit therewith, or can be fitted to the back of the front panel. A guide holder is advantageously fitted to the back of the front panel, if the latter is to be guided on the fixed support frame. Even if the water supply pipe runs, in advantageous, vertical manner and consequently the entire front panel is fitted in vertically directed manner to the wall, it is possible to fit it for certain reasons in an inclined manner. In this case there is a vertical adjustment, parallel to the longitudinal axis of the front panel, along an inclined line. Even with a vertically fitted multiple shower combination, it can be possible for a vertical adjustment along an inclined line.

In one version, the front panel can be made so as to pivot about an axis, particularly an axis running parallel to the longitudinal axis of said panel. By pivoting away both the back of the front panel with the installations located there, and the wall located behind said panel can be reached, which can e.g. be advantageous for cleaning purposes. In the same way installation, maintenance and repair work on the multiple shower combination are facilitated, because there is no need to dismantle the same. If the front panel is so constructed and fittable to the wall that one longitudinal side is spaced from the wall, then the axis about which the front panel is pivoted can advantageously be located outside the central axis of the front panel on said side. Thus, said longitudinal side cannot be wedged on the wall when the front panel is pivoted.

For vertical adjustability and/or pivotability, at least one locking and unlocking device can be provided, which can be released by at least one actuating device. During normal shower operation or in the unused state, the front panel must not pivot or height-adjust of its own accord or by normal use. The at least one locking and unlocking device ensures a settled, fixed position of the front panel. An unlocking device can be so constructed that it permits one or both movements together. In addition, at least one actuating device can be designed so as to permit both movements by releasing at least one locking device.

According to a preferred variant, on the front panel is provided at least one handle, particularly a grip, for height adjustment and/or pivoting the front panel. As a result of such a handle the front panel can be moved easily and particularly favourably in the desired manner. There is no need for a cumbersome, unsure handling of the front panel, which is particularly advantageous when showering, because the front panel is then certainly wet and not particularly easy to grip. Preferably the handle is constructed for one-handed operation.

Directly at or very close to the handle, can be provided at least one actuating device for releasing at least one of the locking devices, in such a way that an operation with one hand is possible of at least one handle accompanied by the simultaneous release of the locking means and the adjustment of the height and/or pivoting of the front panel. One-handed operation permits a particularly comfortable and simple adjustment of the front panel. The at least one actuating device is preferably so fitted that on gripping the handle, it can be operated with one finger, particularly the thumb, which makes it possible for the user to exert a certain force on the actuating device.

In order to increase safety when using and adjusting the front panel, the locking device for vertical adjustment can be constructed in such a way that it is automatically locked on releasing the actuating device.

For activating at least one of the shower operational units, the multiple shower combination can have at least one shifting or reversing element for changing over the water supply to at least one of the shower functional units, which is connected, particularly by a flexible hose, to the water supply pipe. This makes it possible for the user, as desired, to put into operation only one of the shower operational units or specific combinations of said units. The placing of the at least one reversing element on the front of the front panel is preferred. If the reversing element is connected to the water supply pipe with a flexible hose, it is preferably arranged in a U-shaped loop. This permits relative movement between the movable reversing element and the fixed water supply pipe.

Advantageously adequate space is provided between the front panel and the wall for connections, hoses, as well as the guiding and fixing of the multiple shower combination. Thus, the components not required during the normal operation of the multiple shower combination are hidden behind the front panel and the said combination offers a tidy appearance.

Preferably one of the shower operational units is a hand-held shower which, in at least one position, can be fitted to a holder or the like on the front panel and is connected or connectable by a shower hose, particularly on the back of the front panel, to a shifting or reversing element. The hand-held shower can have several operating modes, such as e.g. a massaging jet or a so-called soft jet. If the hand-held shower is fitted or fittable to at least one holder on the front panel, particularly on the front of the latter, the user has both hands free. The shower hose can be of the type conventionally used for hand-held showers. The vertical adjustability of the front panel can be used for the vertical adjustment of the hand-held shower, so that the front panel takes over the function of a vertically adjustable wall bar.

If the shower hose is connected to the reversing element on the back of the front panel, the said hose can be guided closer to the wall than is conventionally the case and projects less far into the shower cubicle. This reduces the probability of a user being caught on the shower hose during the showering or cleaning operations. In addition, the connection of the shower hose to the reversing element preferably takes place on the back of the front panel and is not visible. Thus, the front of the front panel has a tidier appearance.

In order to reduce the number of components, for moving the front panel, the handle can be constructed as a holder for the hand-held shower. As the hand-held shower holder is preferably within gripping distance and has a stable construction for the reliable reception of said shower, it is also suitable for said double function.

If at least one of the holders for the hand-held shower is a conventionally used clamping holder, then in the manufacture of the multiple shower combination it is possible to use proven, existing parts.

Preferably, at least one position of the hand-held shower on a holder corresponds to a position of an overhead shower, the hand-held shower being preferably fittable to the holder in such a way that the shower hose runs behind the front panel. Thus, it is possible to use the same as an overhead shower, preferably at least the rear part of the hand-held shower with the shower hose connection being located in user-invisible manner between the front panel and the wall.

The shower hose can be laid behind the front panel, particularly over a panel side remote from the wall. If the hand-held shower is removed from the holder, then the shower hose can also be fetched from behind the front panel and said shower is once again fully available to the user. In the position as an overhead shower, advantageously only the shower head with the water nozzles are visible. The remainder of the hand-held shower, together with the shower hose, is preferably located behind the front panel. The shower hose length is preferably fixed in such a way that in its concealed position behind the front panel, during a random vertical adjustment of said panel, it does not become visible at its lower end.

An introduction of the shower hose behind the front panel over a side spaced from the wall represents the easiest possibility, which requires no change in the panel position. Alternatively the front panel can be pivoted to the side, so as to introduce the shower hose behind it and can be concealed behind the wall following the pivoting back of the front panel.

For extending the field of use of the multiple shower combination according to the invention, at least one of the shower operational units can be a body shower or side shower, which is preferably located in the lower part of the front panel, especially on its front side, and preferably on its rear side is connected to at least one shifting or reversing element.

Thus, it is possible for the user, as desired, alternatively or additionally to the hand-held shower, to activate a body shower, which preferably deflects the water jet from the side and directly onto the body of the user and not from above onto said user. It is therefore advantageous to position the body shower in the lower part of the front panel. However, other combinations of several body showers are conceivable, in which a plurality of water jets can be directed onto the user. The body shower can be randomly constructed, the use of massaging showers being particularly appropriate. The at least one body shower is vertically adjustable, preferably together with the front panel.

In particularly advantageous manner the direction of the at least one body shower can be adjusted and is in particular randomly adjustable within a given range. Thus, the user can easily adjust the body shower in a desired manner, so as to direct the water jet in desired form onto himself. Flexible hoses and/or rigid connections are conceivable as the reversing or shifting valve.

At least one of the shower operational units can be an overhead shower, which is preferably located in the upper part of the front panel, particularly on its front side and preferably connected at the back to at least one reversing element. Thus, the user has available to him a normal overhead shower. For this purpose he does not have to additionally adjust the hand-held shower or can additionally use the latter. The line from the reversing element to the overhead shower preferably passes behind the front panel. The overhead shower can have a single shower head, or one shower head for different modes. With the reversing element, either the at least one overhead shower can be activated alone, or combined with one or more of the other shower operational units. A positioning in the upper part of the front panel ensures that the water jet is essentially directed from above onto the user and specifically onto his head.

In much the same way as a body shower, the overhead shower can be directionally adjustable, particularly randomly adjustable within a given range. This makes it possible for the user to adjust the overhead shower in a desired manner.

Preferably, the multiple shower combination contains at least one ventilation backup and/or kickback preventer and said at least one backup or preventer is fitted in the path between the wall connection and the connection of the shower hose to the at least one reversing element. In this way the prescribed safety provisions are respected.

The multiple shower combination can be suitable for use in a shower tub and/or a bath tub. This allows a universal use and a wide configurational scope for the user. Thus, overhead showers, which are fixed over a bath tub, can be replaced by the multiple shower combination and a comfortable shower system is created for the user.

For the combination with a bath tub, one of the shower functional units can be a water outlet for filling a tub. When using a multiple shower combination with a bath tub, all the necessary, conceivable water outlet possibilities are available on the multiple shower combination and no further installations are required.

Preferably, the front panel, particularly on the front surface thereof, can have reception elements and/or depositing surfaces for shower utensils. Thus, there is no need to fit e.g. soap dishes or stick-on hooks on the usually tiled shower wall. Use is also made easier, because in the case of a vertical adjustment of the front panel, the shower utensils are always available in a position readily reached by the user. The reception elements and depositing surfaces can either be shaped during the manufacturing process of the front shield or can be subsequently fixed.

It is important and preferred for at least one supply line from the existing wall connection for the overhead shower to at least one shower operational unit to be continually open. As both the hot and cold water line on the upstream mixer tap can be opened, the mixed water can always flow out, so that a correct operation of the mixer tap is ensured.

These and further features can be gathered from the claims, description and drawings and the individual features, either singly or in subcombinations, can be implemented in an embodiment of the invention and in other fields and can represent advantageous, independently protectable constructions for which protection is hereby claimed. The subdivision of the application into individual sections and intermediate subtitles in no way limits the general validity of the statements made thereunder.

BRIEF DESCRIPTION OF THE DRAWINGS

Various embodiments of the invention are described in greater detail hereinafter relative to the attached drawings, wherein show.

DESCRIPTION OF PREFERRED EMBODIMENTS

Figure 1:
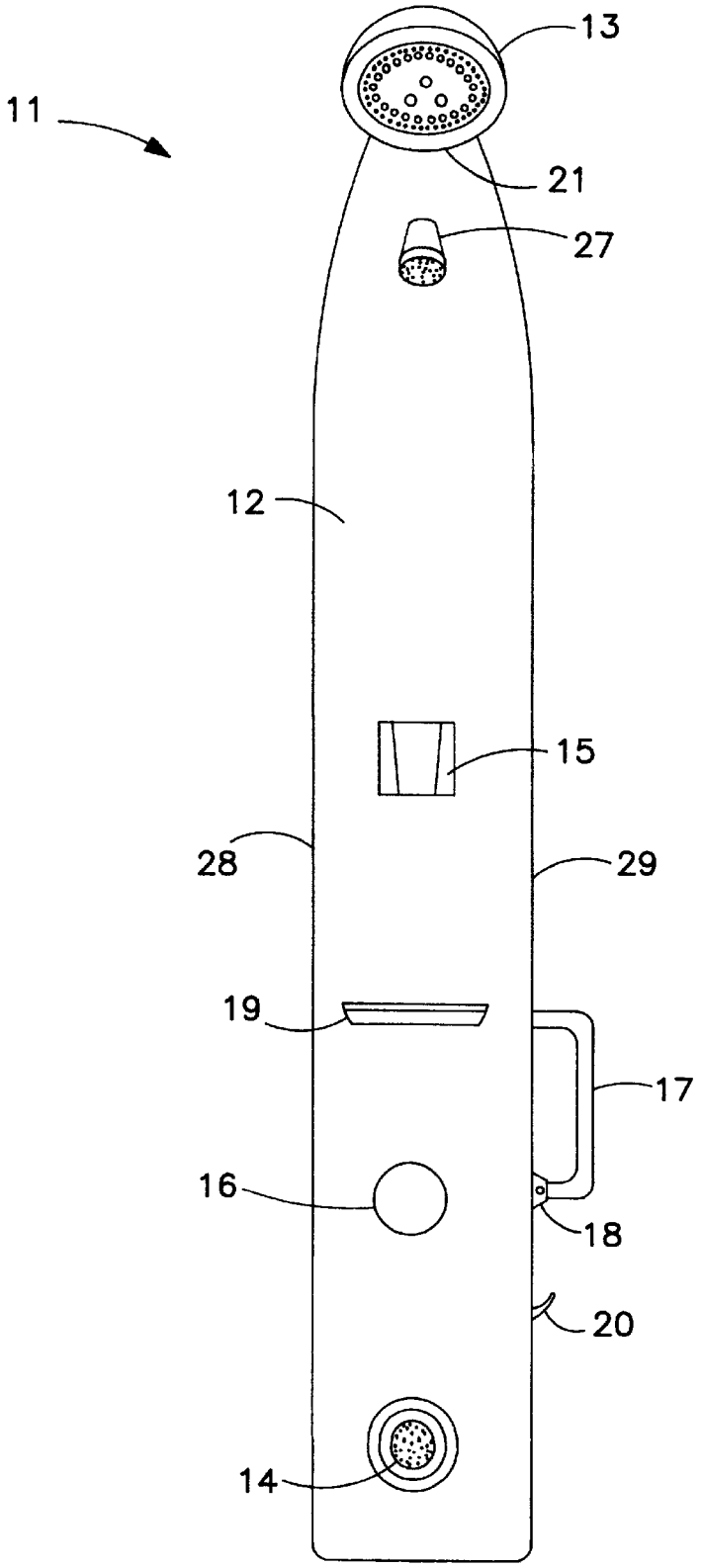
FIG. 1 A front view of the inventive multiple shower combination with a hand-held shower and a body shower, the hand-held shower being in a position of an overhead shower.

FIG. 1 shows the front of the multiple shower combination 11, which has an elongated front panel 12, to whose upper end is fitted a hand-held shower 13 in the position of an overhead shower. Various other elements are fitted to the front panel 12. To its upper end is fitted an overhead shower 27 and to its lower end is fitted as a second operational unit a body shower 14, in which the direction of the water jets passes directly out of the drawing plane. Roughly in the centre of the front panel 12 is fitted a holder 15 for the hand-held shower 13, which is constructed in the manner of a conical holder. Just above the body shower 14 on the front panel 12 is provided a shifting or reversing element 16, with which it is possible to adjust the water supply to the hand-held shower 13 and/or the body shower 14. In the reversing element 16 or the connection leading to the hand-held shower, is provided a ventilation backup and/or a kickback preventer.

To the right-hand side of the front panel 12 is fitted as an operating device a handle 17, whose lower end is pivotably fixed to an articulation or joint 18, whilst the upper end is freely movable.

To the front of the front panel is fitted a depositing surface 19 and on the right-hand side of said panel 12, below the handle 17, a hook 20. On the depositing surface 19 can be deposited soap or a shampoo bottle, whilst on the hook 20 can e.g. be hung a massaging brush provided with a hang-on loop.

The basic shape of the front panel 12 is substantially elongated with parallel longitudinal sides 28 and 29, which roughly in the upper third 22 approach one another with a slight curve, so that the front panel is upwardly tapered and peaks in a receptacle 21 for the hand-held shower 13 positioned as an overhead shower. Thus, the front panel 12 gives a slender, attractive appearance. The various elements are clearly subdivided and at a first glance their function is immediately apparent.

Figure 2:
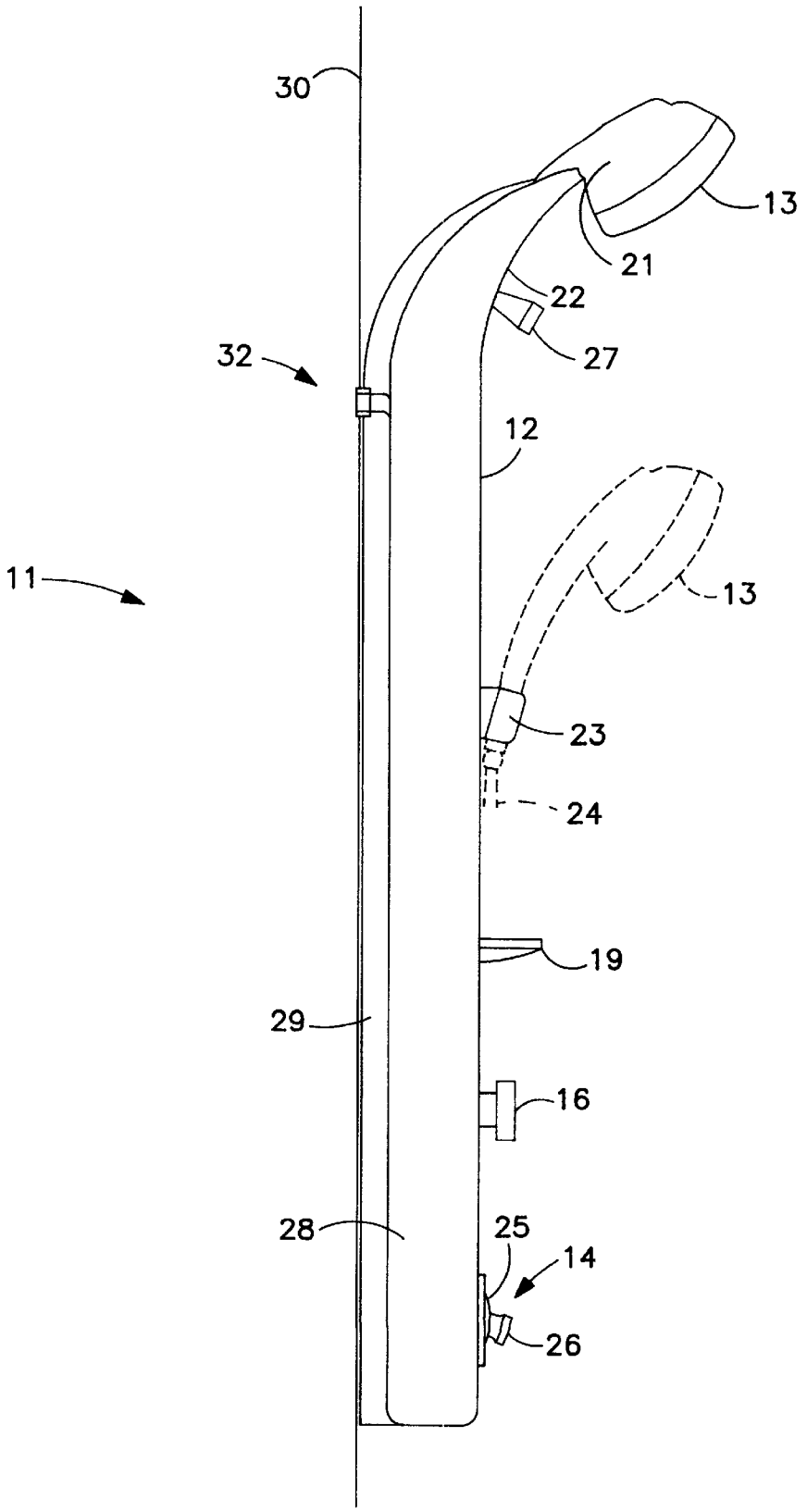
FIG. 2 A side view of the multiple shower combination according to FIG. 1 which shows a shortened side of the front panel and in broken line form the hand-held shower in a further position.

FIG. 2 shows the multiple shower combination 11 from the side. The upper end 22 of the front panel 12 projects roughly in beak-shaped manner over the front of the panel 12. On said upper end 22, the hand-held shower 13 is hung from above in the receptacle 21 as an overhead shower. In a position underneath is fitted the overhead shower 27. The broken line representation shows the hand-held shower 13, which is fixed with the aid of a conical holder 23 in a new position on the front of the front panel 12. In this position the hand-held shower 13 is not partly concealed by the front panel 12, so that a shower hose 24 emanating from the rear end of the hand-held shower 13 is no longer concealed behind the front panel 12. In both positions the hand-held shower 13 is fitted in such a way that its water jet direction is directed forwards and in downwardly inclined manner. In both cases, the mounting support makes it possible to at least partly rotate the hand-held shower 13 in the holder about its longitudinal axis, so that the water jet can be directed at random within a certain pivoting range.

It is also possible to see the body shower 14, which comprises an at least partly cup-shaped articulation piece 25 and a shower head 26 mounted thereon. The body shower 14 is consequently so constructed that it can be pivoted within a certain range in all directions.

The front panel 12 is constructed in such a way that one longitudinal side 28, compared with the other longitudinal side 29, is so shortened that on fitting the multiple shower combination 11 to the wall 30, the edge of the shortened longitudinal side 28 is further spaced from the wall 30 than the edge of the wider longitudinal side 29. In this way, it is also possible to partly see a connection 32 intended both for the water supply to the reversing element 16 and for fixing the multiple shower combination 11 to the wall 30.

Figure 3:
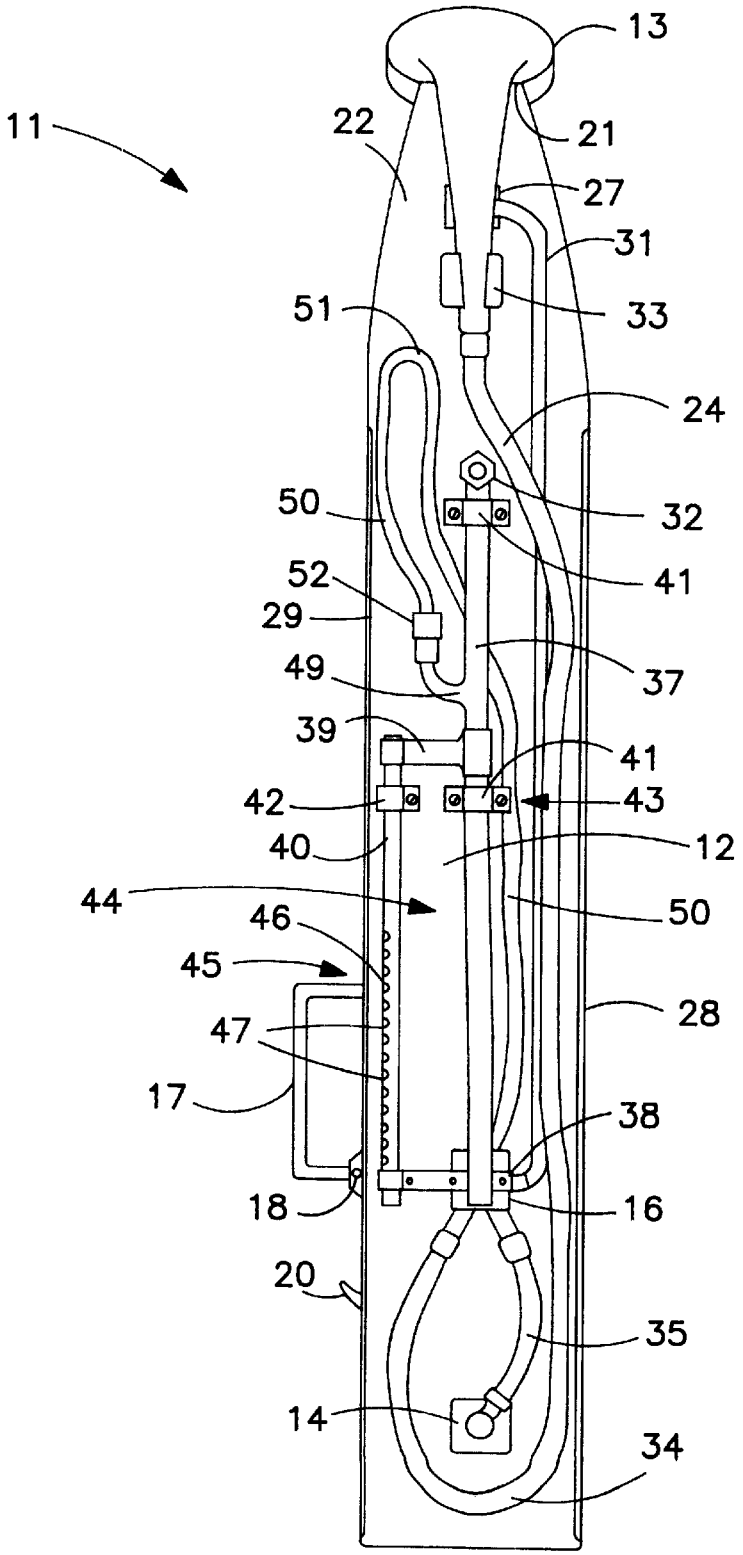
FIG. 3 A back view of the multiple shower combination according to FIG. 1, which inter alia illustrates the construction of the guide means with water supply pipe, the locking device and all the water-carrying hoses and supply lines.

A back view of the multiple shower combination 11 is provided in FIG. 3. To the upper end 22 of the front panel 12, the hand-held shower 13 is fitted additionally to or in place of the receptacle 21 in a holder 33 in such a way that it can be used as an overhead shower. The holder 33 can e.g. be constructed as a clamping holder, like the holder 23. From the rear end of the hand-held shower 13 emanates the shower hose 24, which passes downwards within the two longitudinal sides 28 and 29, in this case on the side of longitudinal side 28, is placed in the lower end of the front panel 12 as a U-shaped loop 34 and is connected to the reversing element 16. The body shower 14 is connected by a short connecting piece 35 to the reversing element 16, while the overhead shower 27 is connected by a long connecting piece 31 to the reversing element. The connecting pieces 35 and 31 can e.g. comprise a hose piece. As both the body shower 14 and the reversing element 16 are firmly fitted to the front panel 12 and consequently cannot approach one another, it is also conceivable to use a fixed connection, e.g. in the form of a pipe or the like.

In the central axis of the back of the front panel 12 passes a water supply pipe 37, which carries at its upper end the connection 32, which is constructed here as a lock nut 63, but other constructions are conceivable. By means of said connection 32, the water supply pipe 37 is connected in water-carrying and also mechanically supporting manner with a wall connection 54 projecting from the wall 30 and shown in FIG. 4. The lower end of the water supply pipe 37, which has no mechanical connection with the reversing element 16 and is located with a horizontal spacing therefrom can, if desired, be fixed by a fixing clip 38 or the like, additionally to the wall 30.

Just above the centre of the water supply pipe 37 a horizontal connecting piece 39 is fitted thereto and to it is fixed a second pipe 40 in a downwards direction and parallel to the pipe 37. By means of two guide bearings 41, which are fitted to the back of the front panel and surround the water supply pipe 37, the front panel 12 is vertically displaceably suspended on the water supply pipe. By means of a further guide bearing 42, with which is displaceably guided the second pipe 40 functioning as a second guide member, a reliable parallel guide mechanical 43 is created, which is also secured against tilting during displacement. The water supply pipe 37 not only serves as a first guide member of the guide mechanism 43, but together with the second pipe 40 also forms a support frame 44 for the front panel 12.

To the left-hand longitudinal side 29 (FIG. 3) of the front panel 12 is fitted the handle or grip 17. Its lower end is so mounted in the joint 18, whose joint axis projects out of the drawing plane, that the upper end of the handle 17 can be pivoted away from the longitudinal side 29 counter to a spring tension. At its upper end the handle 17 passes into a locking bolt 46, which engages through a recess in the longitudinal side 29 in corresponding recesses 47 in the second pipe 40. These recesses 47 are preferably provided at regular intervals on the side of the second pipe 40, serving as the second guide member, directed towards the handle 17. They can be in the form of mere holes or bores, but other variants are also conceivable. The locking bolt 46 and recesses 47 form a locking means 45, which prevents a vertical, undesired sliding of the front panel 12 along the guide mechanism 43. Thus, the front panel 12 is vertically adjustable in stepped manner and prevented from sliding down.

The handle 17 simultaneously serves as an operating device for the locking means 45. It is particularly advantageous if the joint 18 contains a spring mechanism or the like, which presses the handle 17 and in particular its upper end with the locking bolt 46 in the recesses 47. If a user releases the handle 17 and consequently no longer supports the front panel 12, on pivoting back the handle 17, the locking bolt will snap into one of the recesses 47 and lock the locking means 45.

It is also conceivable to equip the handle 17 with an unlocking preventer, so that it can only be unlocked after releasing said preventer. Thus, in the case where the front panel 12 is not or is not to be vertically adjusted, the handle 17 serves as a holding grip for a user and e.g. facilitates safe entry of a possibly slippery shower tub. Even if there is a risk of a user slipping, he can hold firmly on the handle 17 and exert thereon both a vertical and a horizontal force, without the exerting of the horizontal force giving rise to a release of the locking means 45 and there is consequently no need to fear the dropping of the front panel 12.

Just above the connecting piece 39 is provided on the water supply pipe 37 a branch piece 49, to which is fixed a flexible hose 50. This connection comprises a combined ventilation backup and kickback preventer 52 as a securing means. By combination of an upstream back valve and a downstream aerator there is provided an antipollution means. The hose 50 firstly passes upwards along the longitudinal side 29, forms a U-shaped loop 51 and then runs downwards again, where it is connected to the reversing element 16. By means of said hose 50, the reversing element 16 is connected by means of the water supply pipe 37 and the connection 32 for the overhead shower wall connection 54. Thus all the shower operational units are connected in water-carrying manner with the reversing element 16 fixed to the front panel 12 and are vertically adjustable together with the latter. The water supply pipe 37 only needs to carry water up to the branch piece 49. The U-shaped loop 51 serves to compensate length differences of the connection between the branch piece 49 and the reversing element 16, because they can move relative to one another during the adjustment of the front panel 12. In principle, the hose 50 can be freely laid, but it is advantageous to fit to the back of the front panel 12 a guide, which aids or forces the positioning of the hose 50 in the U-shaped loop 51.

The two pipes 37 and 40 which, together with the connecting piece 39 form the support frame 44, are made from a correspondingly stable material and to facilitate mutual connection preferably the same material, in order to reliably fulfil this function. As at least the upper part of the water supply pipe 37 is water-carrying, a copper pipe construction is advisable and ensures an adequate stability due to an adequate wall thickness. All the connections, such as the connecting piece 39 and the branch piece 49, can be hard soldered. The guide bearings 41 and 42 are preferably made from a plastics material conventionally used for such purposes, e.g. Nylon or polyamide. With the aid of screws, they can be fixed to bases shaped or fitted to the back of the front panel 12.

The length of the shower hose 24 is adjusted in such a way that on fitting the hand-held shower 13 in the holder 33, the U-shaped loop 34, which forms the lowest point of the hose 24, does not extend below the lower edge of the front panel 12, when the latter is moved upwards.

The construction of the multiple shower combination 11 in FIG. 3 is not pivotable about a vertical axis as a result of the fixed connection of the two guide elements, formed by the pipes 37 and 40. Thus, in this embodiment, one of the longitudinal sides, in this case longitudinal side 28, is shortened and spaced from the wall, so that the shower hose 24 can be concealed behind the front panel 12. However, a pivotability of the front panel, particularly about the pipe 40 can be provided, because the support frame 44 is only connected in water-carrying manner to the front panel 12 by the flexible hose 50. For the mechanical pivoting connection several guide bearings 42 on pipe 40 are adequate. The guide bearings 41 on pipe 37 can then be omitted. The handle 17 could project from the wall 30 in order not to impede the pivoting movement.

Figure 4:
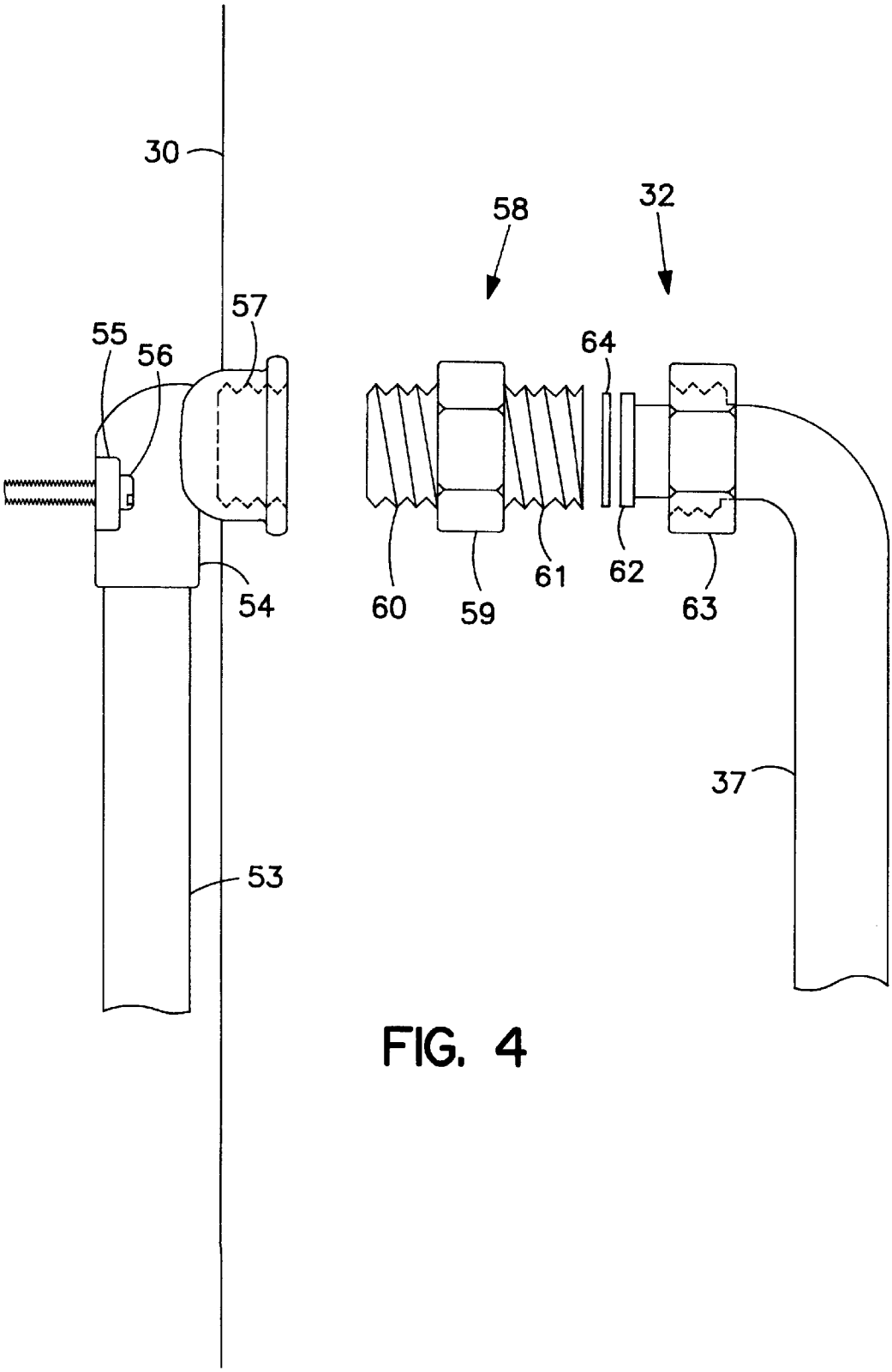
FIG. 4 The wall connection, a connecting piece and the water supply pipe with a locking nut, on a larger scale compared with FIGS. 1 to 3.

FIG. 4 shows a connection possibility of the water supply pipe 37 to the water pipe 53, which runs behind the wall 30 and which projects over said wall 30 with a wall connection 54 bent at right angles. The wall connection 54 is preferably provided on both sides with short webs 55, which are firmly anchored with the aid of screws 56 or the like in the wall or brickwork. The portion of the wall connection 54 projecting from the wall 30 is provided with an internal thread 57, which is e.g. in the form of a half-inch or NPT thread. A matching tubular connecting piece 58 can be screwed into said internal thread 57. This connecting piece 58 comprises a centre piece 59 constructed as a hexagonal nut and from which pass on either side short threaded sockets 60, 61. The connecting piece 58 is screwed with the left-hand threaded socket 60 in the wall connection 54. To the right-hand threaded socket 61 is fitted a flange 62, which forms the end of the water supply pipe 37, which is bent at right angles, and is tightly connected by a lock nut 63 to the connecting piece 58.

For example, between the right-hand threaded socket 61 and the flange 62 can be inserted a front seal 64 made from plastic or some other suitable sealing material. The water supply pipe 37 is mechanically carried by the lock nut 63, so that the connection between the threaded socket 61 and the flange 62 does not have to withstand shear forces. Preferably the external dimensions of the centre piece 59 and the lock nut 63 are the same, so that they can be fitted with the same tool. The connecting piece 58 is preferably made from metal, e.g. copper. The mechanical stability of the water-carrying connection is suitable for carrying the entire multiple shower combination 11. There is no need for additional connections, e.g. the fastening clip 38, but they may prove useful for lateral stability purposes. Possibly a textile stick connection or an adhesive connection may be adequate.

Figure 5:
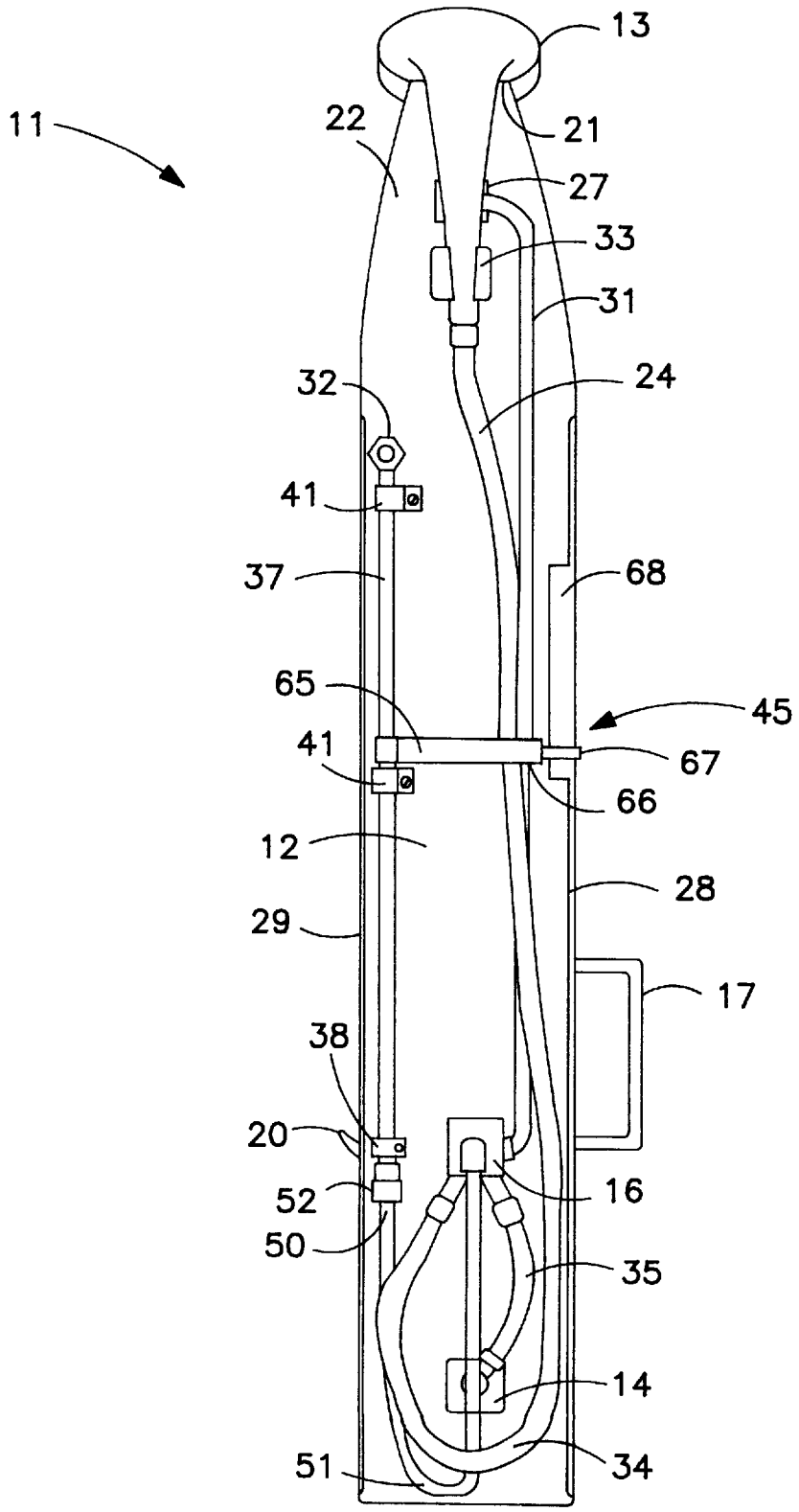
FIG. 5 A back view of another embodiment, in which the water supply pipe is located outside the central axis of a front panel and a second guide member in the form of a guide rail is shaped onto the front panel.
Figure 6:
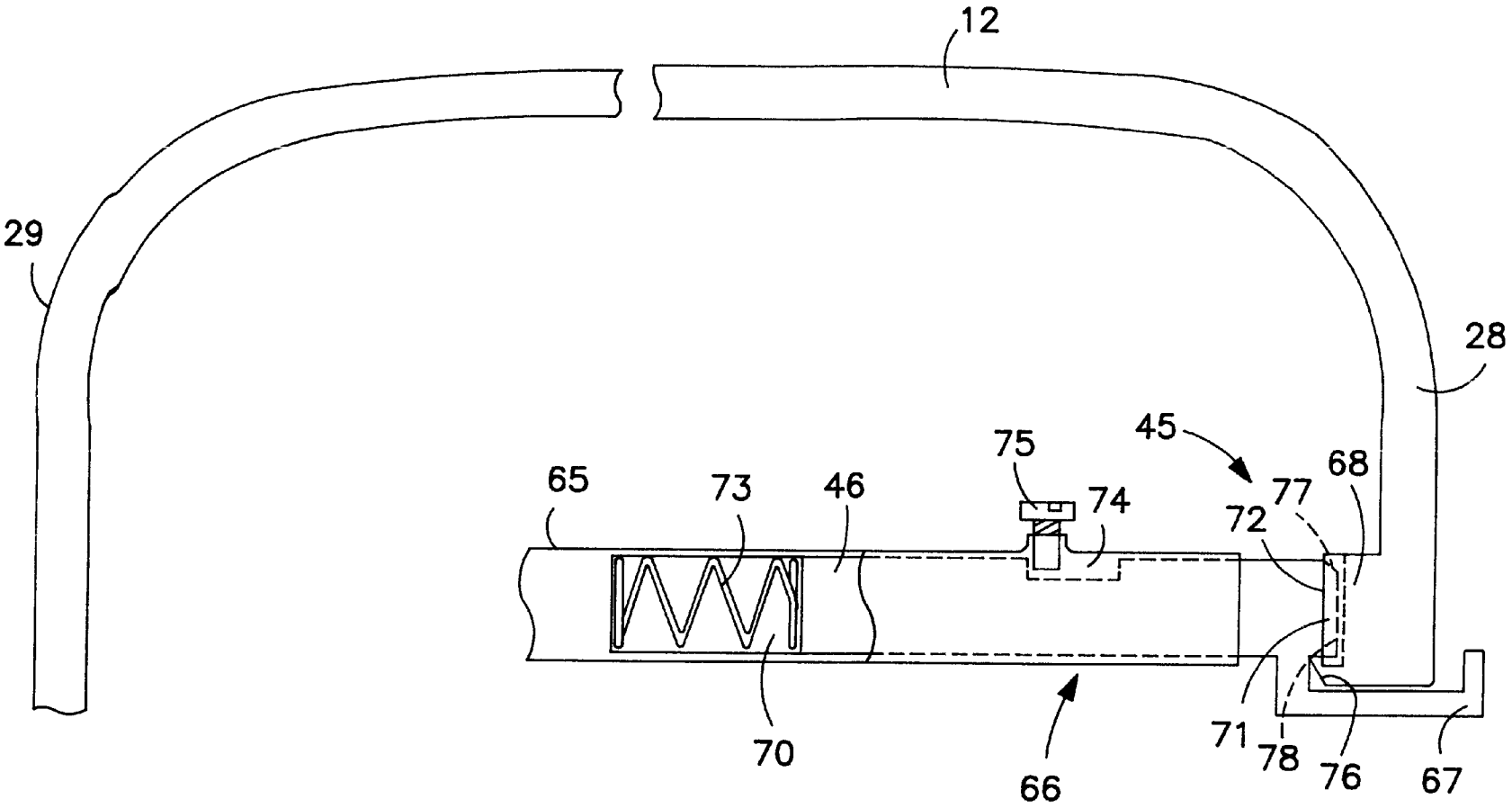
FIG. 6 is a cross-section looking through the locking device of FIG. 5 and shows the front panel with a generally U-shaped cross sectional profile.

In FIG. 5, where corresponding parts are given the same reference numerals, is shown a construction of the multiple shower combination 11, in which particularly the guide mechanism 43 and support frame 44 are constructed in accordance with further inventive features. In the rear view of the front panel 12 the water supply pipe 37 is located on the side of the longitudinal side 29. As described hereinbefore, it is provided on its top with the connection 32 and two spaced guide bearings 41, as well as optionally a fastening clip 38 at its lower end. Just above its centre at right angles thereto emanates an arm 65 rigidly connected to the water supply pipe 37, which extends virtually over the entire width of the front panel 12 up to the other longitudinal side 28. To the end of the arm 65 is fitted in a holder 66 a locking element 67, which forms with a guide rail 68 fitted to the side of the front panel 12 a locking mechanism 45. By pressing the locking element 67 in the direction of the longitudinal axis thereof, the locking mechanism 45 is released, so as to permit a vertical adjustment of the front panel 12. Thus, the locking element 67 also constitutes the operating device for the locking mechanism 45. FIG. 6 provides details of the construction of the locking mechanism 45.

The release of the locking mechanism 45 takes place in such a way that there is no longer a connection between the locking element 67 and the guide rail 68, so that according to another feature of the invention the front panel 12 can be pivoted away from the wall 30 about the water supply pipe 37. The guide bearings 41 not only permit a vertical movement with respect to the water supply pipe 37 fixed to the wall 30, but also a rotary movement about the water supply pipe axis. A pivoting away of the front panel 12 permits a particularly easy fitting of the connection 32 to the wall connection 54 and facilitates maintenance and cleaning. As a concealment of the shower hose 42 is made possible by the pivoting away of the front panel 12, the longitudinal side 28 need not be spaced from the wall 30 in the pivoted in state.

The support frame 44 is here mainly formed by the vertical water supply pipe 37 and the horizontal arm 65.

The hose 50 for connecting the reversing element 16 to the water supply pipe 37, in this case emanates from the combined ventilation backup and kickback preventer 52 at the lower end of the latter and is in the downwards direction in the form of a U-shaped loop 51. This version of the connection has the major advantage that there is no branch piece 49 on the water supply pipe 37. In addition, the hose 50 can be considerably shorter. The entire water supply pipe 37 is generally designed for a water supply. The length of the hose 50 is such that the U-shaped loop 51, compensates the positioning differences between the reversing element 16 and the water supply pipe 37 during the vertical adjustment of the front panel 12 and on the one hand is sufficiently long to utilize the complete displacement path, but on the other in no position of the front panel 12 does it project below the lower edge of the latter. For this purpose, preferably there is a guide and deflecting plate, which guides the hose 50 preferably close to the inside of the front panel 12 and shields it against the shower hose 24 passing partly above it and its U-shaped loop 34.

Otherwise the reversing element 16 and the overhead shower 27 and the body shower 14 and hand-held shower 13, together with the connections thereof to the reversing element 16 are the same as in FIGS. 1 to 3.

As the handle 17 does not serve as a grip for the locking mechanism 45, it can be rigidly fitted to or shaped on the side of the front panel 12 remote from the water supply pipe 37. Unlike what is shown in the drawing, the handle 17 can also be combined with the locking element, so that one-handed operation is possible, as in the embodiment of FIGS. 1 to 3.

FIG. 6 shows a section through the locking mechanism 45 and holder 66. On the side facing the guide rail 68, the arm 65 is hollow or provided with a bore 70. In said bore 70 runs a locking bolt 46, to whose end projecting from the arm 65 is fitted the locking element 67. The front end, which engages in the guide rail 68, can be provided with a single or multiple-step notching 71, which engages in corresponding recesses 72 of the guide rail 68. The locking bolt 46 is pressed into the guide rail 68 by a spring 73, which is supported on the bottom of the bore 70. The spring 73 can be constituted by a similar spring element. So that in the case of an open locking mechanism 45 the locking bolt 46 cannot be forced by the spring 73 out of the bore 70, it can be provided with an elongated recess 74, in which engages a locking screw 75 screwed into a thread on the outside of the arm 65. This locking screw 75, which after the insertion of the locking bolt 46 projects into the bore 70, permits a displacement of the locking bolts 46 only within a certain range. Other securing means for the locking bolt 46 are possible.

The guide rail 68 is provided on its part facing the wall 30 with a guide nose 76, which is bevelled on the side remote from the locking bolt 46. Matching the bevel of the guide nose 76, the side of the locking bolt 46 remote from said nose is also provided with a bevel 77. The two bevels 76 and 77 are such that when the locking system is released and the front panel 12 pivoted away, the locking mechanism 45 is closed solely by pivoting the front panel 12 up to the wall 30. By sliding along the bevel 77, the bevel of the nose 76 pressed back the locking bolt 46, so that the notching 71 can engage in the recesses 72. The guide nose 76 can project by a portion over the front edge of the recess 72, so that on pressing in the locking bolt 46, the front edge 78 of the notching 71 is released from connection with the recess 72, so that the height of the front panel 12 can be adjusted. However, the leading edge 78 can still be behind the leading edge of the guide nose 76, so that a pivoting of the front panel is still not possible. The pivoting of the front panel 12 is only necessary e.g. for the insertion of the shower hose 24 or for installation and cleaning purposes. It would also be conceivable to have a stepped or additional, second spring element for the unlocking of the pivoting movement and which is compressed at the moment when the notching 71 no longer engages in the recesses 72. A user feels from the suddenly strongly increasing resistance that vertical adjustability is possible. Only when further, additional pressure is exerted by means of the locking element 67 on the locking belt 46, does the guide nose 76 come free from the leading edge 78 of the notching and the front panel 12 can be pivoted.

The locking mechanism 45 is preferably so constructed that a pivoting movement is only possible in the bottom position of the front panel 12. This can e.g. be brought about in that the guide nose 76 is sufficiently short in the upper area of the guide rail 68 that it can be pivoted in over the unlocked locking bolt 46.

The notching 71 and recess 72 are preferably designed in such a way that they ensure a self-securing of the front panel 12 against dropping down, e.g. in the case of a sudden release of the locking mechanism. The guide rail 68 with the guide nose 76 can either be shaped on the front panel during the manufacturing process or at a subsequent time, e.g. using a screw fitting.

FIG. 6 also partly shows the U-shaped profile of the front panel 12.

We claim:

1. Multiple shower combination having at least two shower operational units, wherein the shower combination is connectable to a wall connection for an overhead shower, the shower combination having a front panel which is vertically adjustable when the shower combination is coupled to the wall connection for the overhead shower, at least one guide mechanism with at least one guide holder on at least one guide member for guidance of said front panel.

2. Multiple shower combination according to claim 1, wherein said guide mechanism is provided on a back of said front panel for facing a wall.

3. Multiple shower combination according to claim 1, further comprising a support frame whereby a position of said support frame on a wall is determined by said wall connection.

4. Multiple shower combination according to claim 3, wherein said at least one guide member is formed by said support frame.

5. Multiple shower combination according to claim 3, wherein a water supply pipe is connectable to said wall connection.

6. Multiple shower combination according to claim 5, wherein said water supply pipe is part of said support frame.

7. Multiple shower combination according to claim 1, wherein said front panel is pivotable about an axis.

8. Multiple shower combination according to claim 1, further comprising at least one locking mechanism coupled to the front panel, said locking mechanism being releasably coupled to at least one actuating device in order to permit adjustment of the front panel.

9. Multiple shower combination according to claim 1, further comprising an operating device for adjustment of said front panel.

10. Multiple shower combination according to claim 1, wherein at least one of said shower operational units can be fitted to said front panel.

11. Multiple shower combination according to claim 5, further comprising at least one reversing element for reversing the water supply to at least one of said shower operational units connected to said water supply pipe.

12. Multiple shower combination according to claim 11, wherein said reversing element is connected by a flexible hose to said water supply pipe.

13. Multiple shower combination according to claim 1, wherein one of said shower operational units is a handheld shower, which can be fitted in at least one position to a holder on said front panel and is connected by a shower hose to a reversing element.

14. Multiple shower combination according to claim 13, wherein at least one position of said hand-held shower an a holder corresponds to a position of an overhead shower.

15. Multiple shower combination according to claim 14, wherein said hand-held shower can be fitted to said holder so that said shower hose can be concealed behind said front panel.

16. Multiple shower combination according to claim 1, wherein at least one of said shower operational units is a body shower, which is connected to a reversing element at a back of said front panel.

17. Multiple shower combination according to claim 16, wherein in the lower part of said front panel said body shower is located on a visible side of the shower combination.

18. Multiple shower combination according to claim 1, wherein at least one of said shower operational units is an overhead shower, wherein an upper part of said front panel is located on a visible side of the shower combination and a reversing element is connected to a back side of the shower combination.

19. Multiple shower combination according to claim 13, comprising at least one securing means selected from the group of ventilation backups and kickback preventers and wherein said securing means is fitted in a path between said wall connection and the connection of said shower hose to said reversing element.

20. Multiple shower combination according to claim 1, further comprising reception elements and depositing surfaces for shower utensils on said front panel.

21. Multiple shower combination according to claim 1, wherein at least one supply line from said wall connection to said overhead shower is always opened to at least one of said shower operational units.

22. Multiple shower combination according to claim 21, wherein supply lines to other shower operational units are alternatively openable by an adjusting member selected from the group of reversing and shifting elements and valves.

23. Multiple shower combination according to claim 22, wherein at least one supply line from said wall connection to the overhead shower is always opened to at least one of said shower operational units.

24. Multiple shower combination having at least two shower operational units, wherein the shower combination is connectable to a wall connection for an overhead shower, the shower combination having a front panel and wherein two sides of said front panel are bent towards a back surface of the shower combination thereby forming an approximately U-shaped cross-sectional profile.

25. Multiple shower combination having at least two shower operational units, further comprising a front panel which is vertically adjustable when the shower combination is coupled to the wall connection for the overhead shower, at least one guide mechanism with at least one guide holder on at least one guide member for guidance of said front panel.

26. Multiple shower combination according to claim 25, wherein said guide mechanism is provided on a back of the front panel for facing a wall.

27. Multiple shower combination according to claim 25, wherein the shower combination is connectable to a wall connection for an overhead shower.

28. Multiple shower combination according to claim 27, further comprising a support frame whereby a position of said support frame on a wall is determined by said wall connection.

29. Multiple shower combination according to claim 28, wherein said at least one guide member is formed by said support frame.

30. Multiple shower combination according to claim 29, wherein a water supply pipe is connectable to said wall connection.

31. Multiple shower combination according to claim 28, wherein said water supply pipe is part of said support frame.

32. Multiple shower combination according to claim 25, wherein said front panel is pivotable about an axis.

33. Multiple shower combination according to claim 25, further comprising at least one locking mechanism coupled to the front panel, said locking mechanism being releasably coupled to at least one actuating device in order to permit adjustment of the front panel.

34. Multiple shower combination according to claim 25, further comprising an operating device for adjustment of said front panel.

35. Multiple shower combination according to claim 25, wherein at least one of said shower operational units can be fitted to said front panel.

36. Multiple shower combination according to claim 31, further comprising at least one reversing element for reversing the water supply to at least one of said shower operational units connected to said water supply pipe.

37. Multiple shower combination according to claim 36, wherein said reversing element is connected by a flexible hose to said water supply pipe.

38. Multiple shower combination according to claim 25, wherein one of said shower operational units is a handheld shower, which can be fitted in at least one position to a holder on said front panel and is connected by a shower hose to a reversing element.

39. Multiple shower combination according to claim 38, wherein at least one position of said hand-held shower on a holder corresponds to a position of an overhead shower.

40. Multiple shower combination according to claim 39, wherein said hand-held shower can be fitted to said holder so that said shower hose can be concealed behind said front panel.

41. Multiple shower combination according to claim 25, wherein at least one of said shower operational units is a body shower, which is connected to a reversing element at a back of said front panel.

42. Multiple shower combination according to claim 41, wherein in a lower part of said front panel said body shower is located on a visible side of the shower combination.

43. Multiple shower combination according to claim 25, wherein at least one of said shower operational units is an overhead shower, wherein an upper part of said front panel is located on a visible side of the shower combination and a reversing element is connected to a back side of the shower combination.

44. Multiple shower combination according to claim 38, further comprising at least one securing means selected from the group of ventilation backups and kickback preventers and wherein said securing means is fitted in a path between said wall connection and the connection of said shower hose to said reversing element.

45. Multiple shower combination according to claim 25, further comprising reception elements and depositing surfaces for shower utensils on said front panel.

46. Multiple shower combination according to claim 27, wherein at least one supply line from said wall connection to the overhead shower is always opened to at least one of said shower operational units.

47. Multiple shower combination according to claim 46, wherein the supply lines to other shower operational units are alternatively openable by an adjusting member from the group of reversing and shifting elements and valves.

48. Multiple shower combination according to claim 47, wherein at least one supply line from said wall connection to the overhead shower is always opened to at least one of said shower operational units.

49. Multiple shower combination having at least two shower operational units, wherein the shower combination is connectable to a wall connection for an overhead shower, the shower combination having a front panel, wherein one of said shower operational units is a hand-held shower, which can be fitted in at least one position to a holder on said front panel and is connected by a shower hose to a reversing element, wherein at least one position of said hand-held shower on a holder corresponds to a position of an overhead shower and wherein said hand-held shower can be fitted to said holder so that said shower hose can be concealed behind said front panel.

50. Multiple shower combination having at least two shower operational units, the shower combination having a front panel, wherein one of said shower operational units is a hand-held shower, which can be fitted in at least one position to a holder on said front panel and is connected by a shower hose to a reversing element, wherein at least one position of said hand-held shower on a holder corresponds to a position of an overhead shower and wherein said hand-held shower can be fitted to said holder so that said shower hose can be concealed behind said front panel.

* * * * *